US010890337B1

(12) United States Patent
Arbogast et al.

(10) Patent No.: US 10,890,337 B1
(45) Date of Patent: Jan. 12, 2021

(54) RETRACTABLE STOVETOP SHIELDING SCREEN

(71) Applicants: Eric Arbogast, Chandler, AZ (US); Milena Arbogast, Chandler, AZ (US)

(72) Inventors: Eric Arbogast, Chandler, AZ (US); Milena Arbogast, Chandler, AZ (US)

( * ) Notice: Subject to any disclaimer, the term of this patent is extended or adjusted under 35 U.S.C. 154(b) by 212 days.

(21) Appl. No.: 16/208,726

(22) Filed: Dec. 4, 2018

(51) Int. Cl.

| | |
|---|---|
| ***F24C 15/36*** | (2006.01) |
| ***F24C 3/12*** | (2006.01) |
| ***E06B 9/52*** | (2006.01) |
| ***E06B 9/78*** | (2006.01) |
| ***E06B 9/08*** | (2006.01) |

(52) U.S. Cl.
CPC ..... *F24C 15/36* (2013.01); *E06B 9/08* (2013.01); *E06B 9/52* (2013.01); *E06B 9/78* (2013.01); *F24C 3/122* (2013.01)

(58) Field of Classification Search
CPC ..... F24C 15/36; F24C 3/122; F24C 15/2007; F24C 15/20; F24C 15/2021; F24C 15/00; F24C 15/2042; F24C 15/28; F24C 15/30; E06B 9/08; E06B 9/52; E06B 9/78; A47J 36/36
See application file for complete search history.

(56) References Cited

U.S. PATENT DOCUMENTS

| | | | | |
|---|---|---|---|---|
| 3,559,636 | A | 2/1971 | Marino | |
| 4,155,343 | A | 5/1979 | Hartman | |
| 4,517,955 | A | 5/1985 | Ehrlich | |
| 4,527,540 | A | 7/1985 | Ryan | |
| D351,760 | S | 10/1994 | Frank | |
| 5,793,021 | A | 8/1998 | Walton | |
| 5,842,464 | A | 12/1998 | Koch | |
| 2018/0149367 | A1 * | 5/2018 | Faulstich | A47J 37/1271 |

FOREIGN PATENT DOCUMENTS

| | | |
|---|---|---|
| CA | 1223492 | 6/1987 |

* cited by examiner

*Primary Examiner* — Alfred Basichas

(57) ABSTRACT

The retractable stovetop shielding screen is a wire mesh screen that may be deployed from an above-stove support such as a range hood or microwave oven to prevent children and pets from contacting the stovetop. The screen mounts to the front of the above-stove support using a pair of L-shaped mounting brackets. When not deployed, a spring loaded roller retracts the screen to a position above the stovetop. The screen is deployed by pulling a grip and the screen unwinds from the roller, stretching between the roller and the handle of the oven door below. The screen removably couples to the oven door handle using a loop kept closed by hook and loop fasteners. The screen is non-opaque, allowing items on the stovetop to be seen even when the screen is deployed.

18 Claims, 5 Drawing Sheets

RETRACTABLE STOVETOP SHIELDING SCREEN

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of household safety devices, more specifically, a retractable stovetop shielding screen.

SUMMARY OF INVENTION

The retractable stovetop shielding screen is a wire mesh screen that may be deployed from an above-stove support such as a range hood or microwave oven to prevent children and pets from contacting the stovetop. The screen mounts to the front of the above-stove support using a pair of L-shaped mounting brackets. When not deployed, a spring loaded roller retracts the screen to a position above the stovetop. The screen is deployed by pulling a grip and the screen unwinds from the roller, stretching between the roller and the handle of the oven door below. The screen removably couples to the oven door handle using a loop kept closed by hook and loop fasteners. The screen is non-opaque, allowing items on the stovetop to be seen even when the screen is deployed.

An object of the invention is to deploy a screen that prevents children and pets from contacting a stovetop or items on the stovetop.

Another object of the invention is to provide a non-opaque screen that allows items on the stovetop to be seen when the screen is deployed.

A further object of the invention is to provide a spring loaded roller to retract and store the screen when it is not deployed.

Yet another object of the invention is to hold the deployed screen in place using a sloop coupled to the handle of the oven door.

These together with additional objects, features and advantages of the retractable stovetop shielding screen will be readily apparent to those of ordinary skill in the art upon reading the following detailed description of the presently preferred, but nonetheless illustrative, embodiments when taken in conjunction with the accompanying drawings.

In this respect, before explaining the current embodiments of the retractable stovetop shielding screen in detail, it is to be understood that the retractable stovetop shielding screen is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the retractable stovetop shielding screen.

It is therefore important that the claims be regarded as including such equivalent construction insofar as they do not depart from the spirit and scope of the retractable stovetop shielding screen. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, the word "or" is intended to be inclusive.

Figure 1:
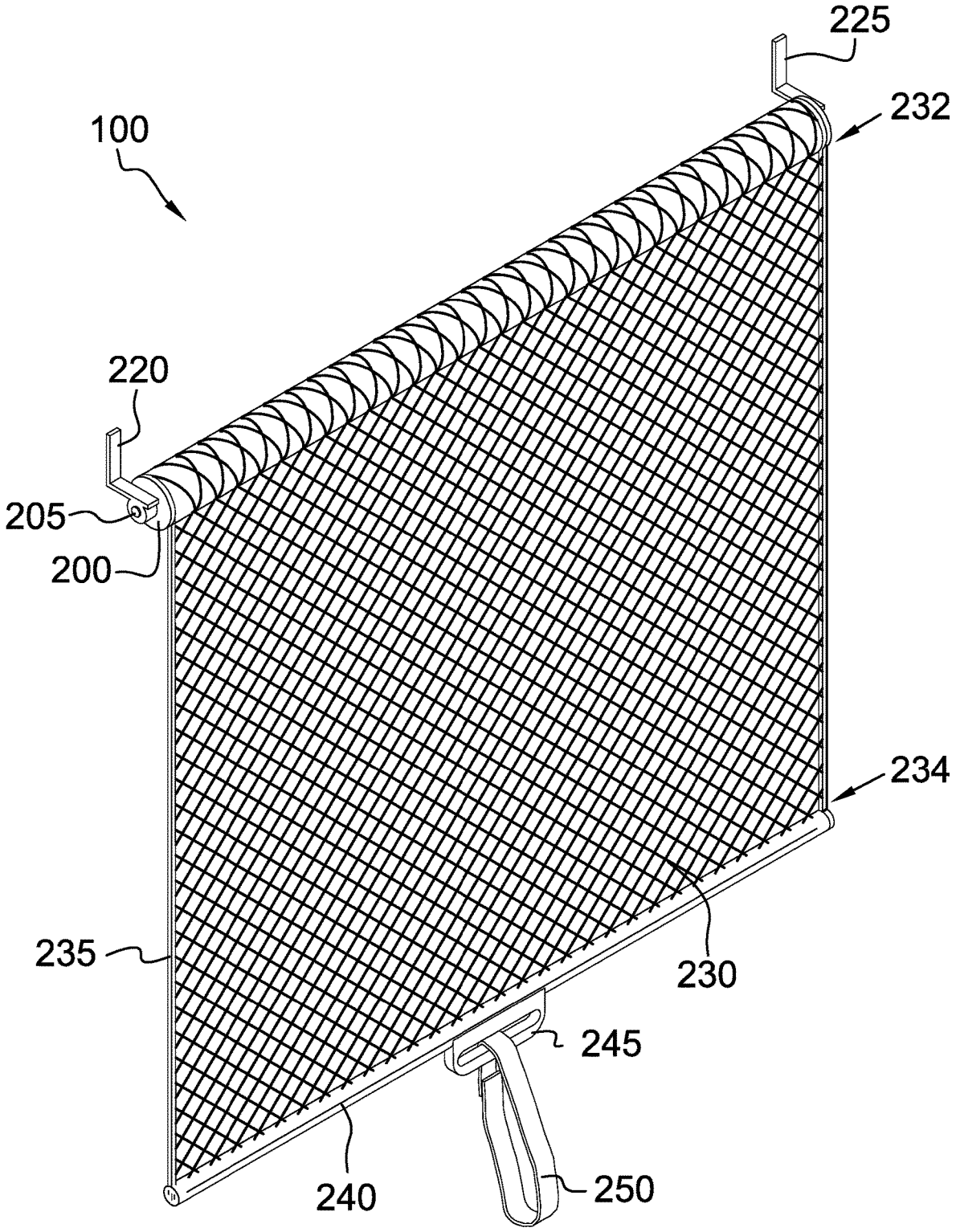
FIG. 1 is a perspective view of an embodiment of the disclosure.
Figure 2:
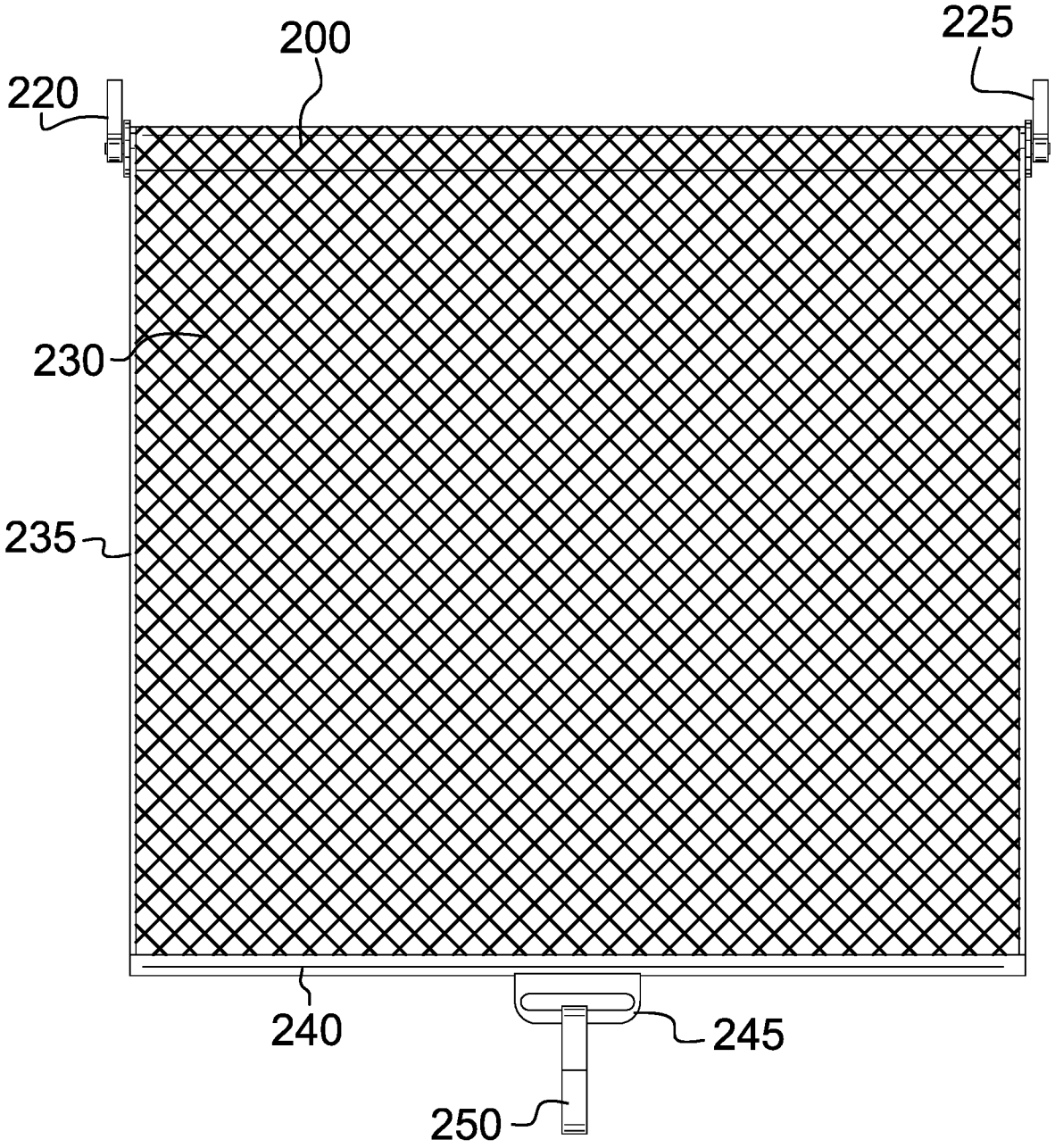
FIG. 2 is a top view of an embodiment of the disclosure.
Figure 3:
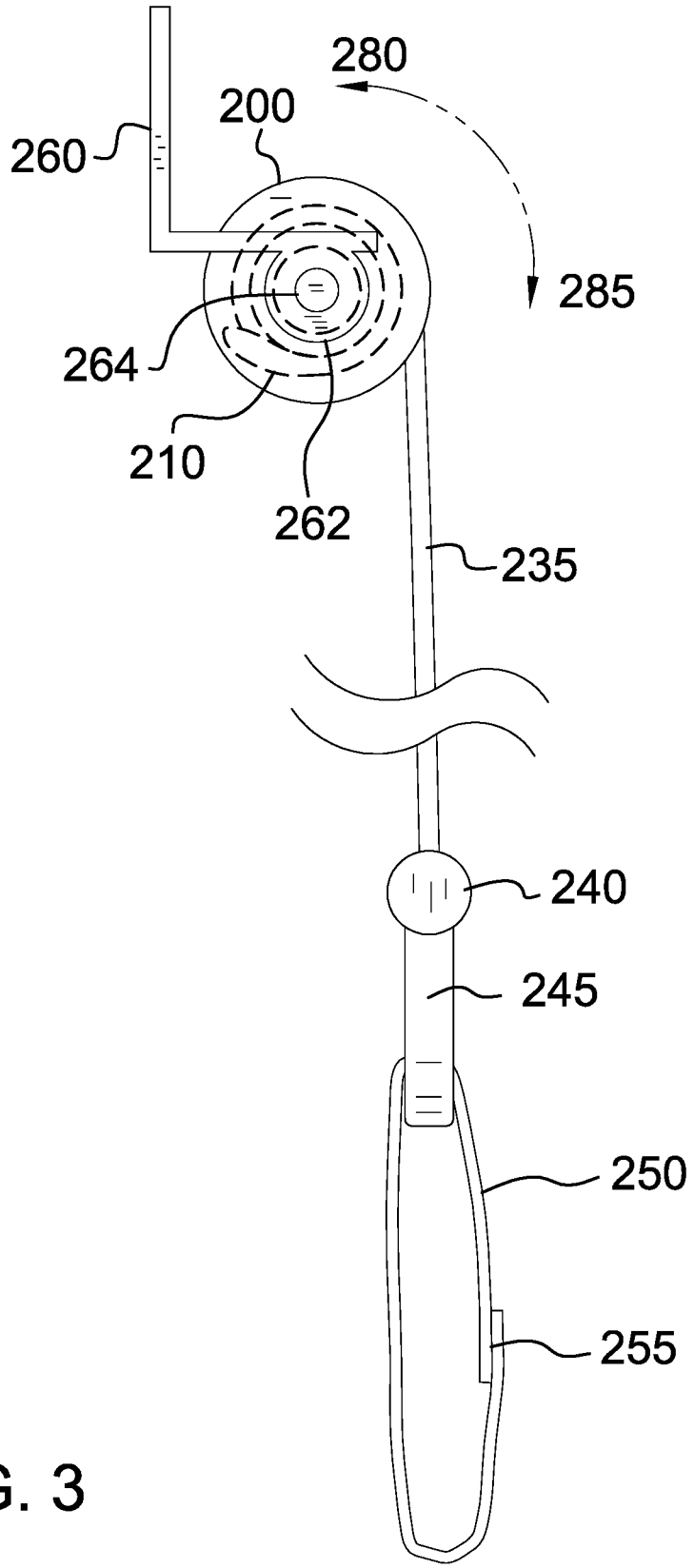
FIG. 3 is a side view of an embodiment of the disclosure.
Figure 4:
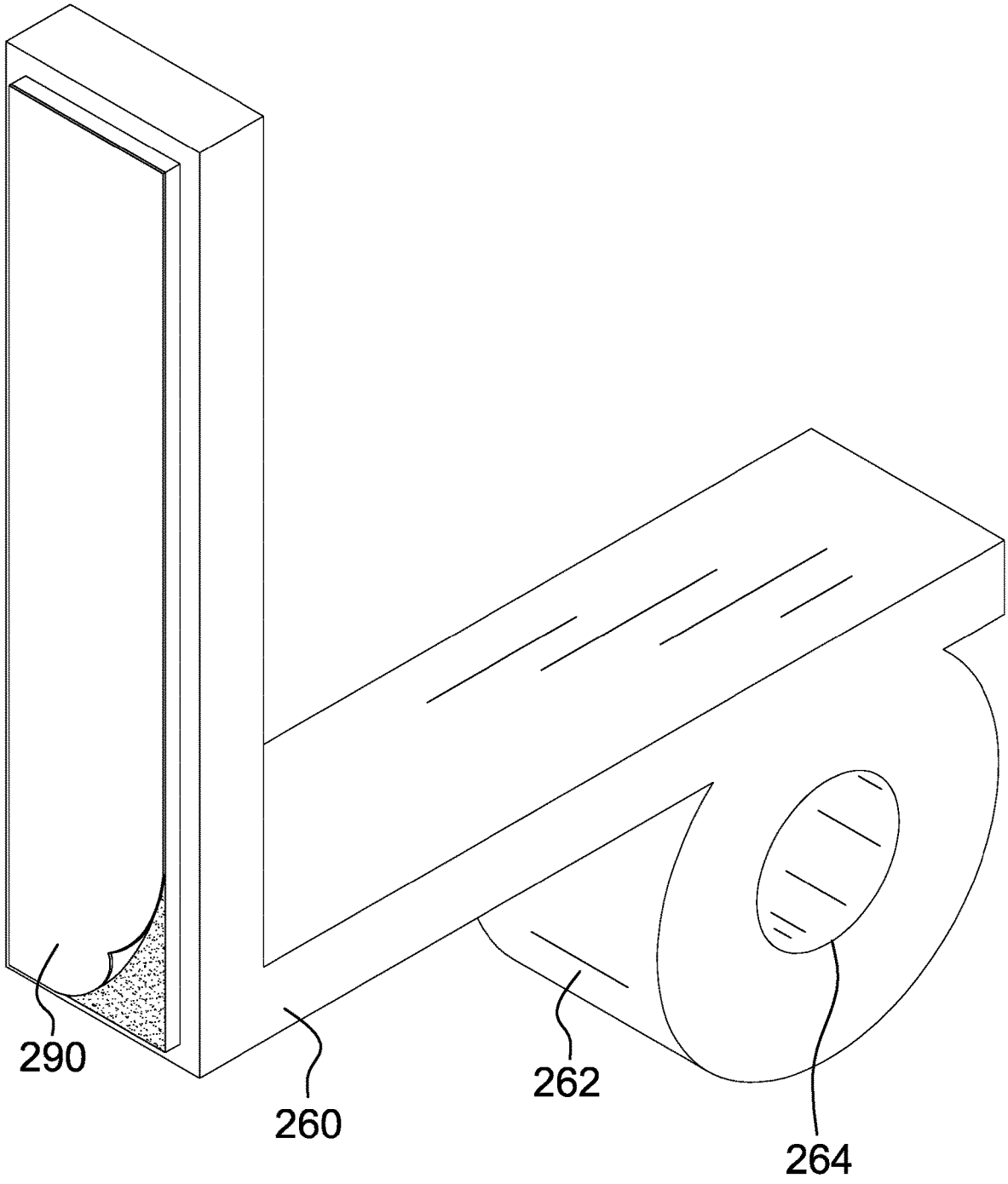
FIG. 4 is a detail view of an embodiment of the disclosure illustrating one of the L-shaped mounting brackets.
Figure 5:
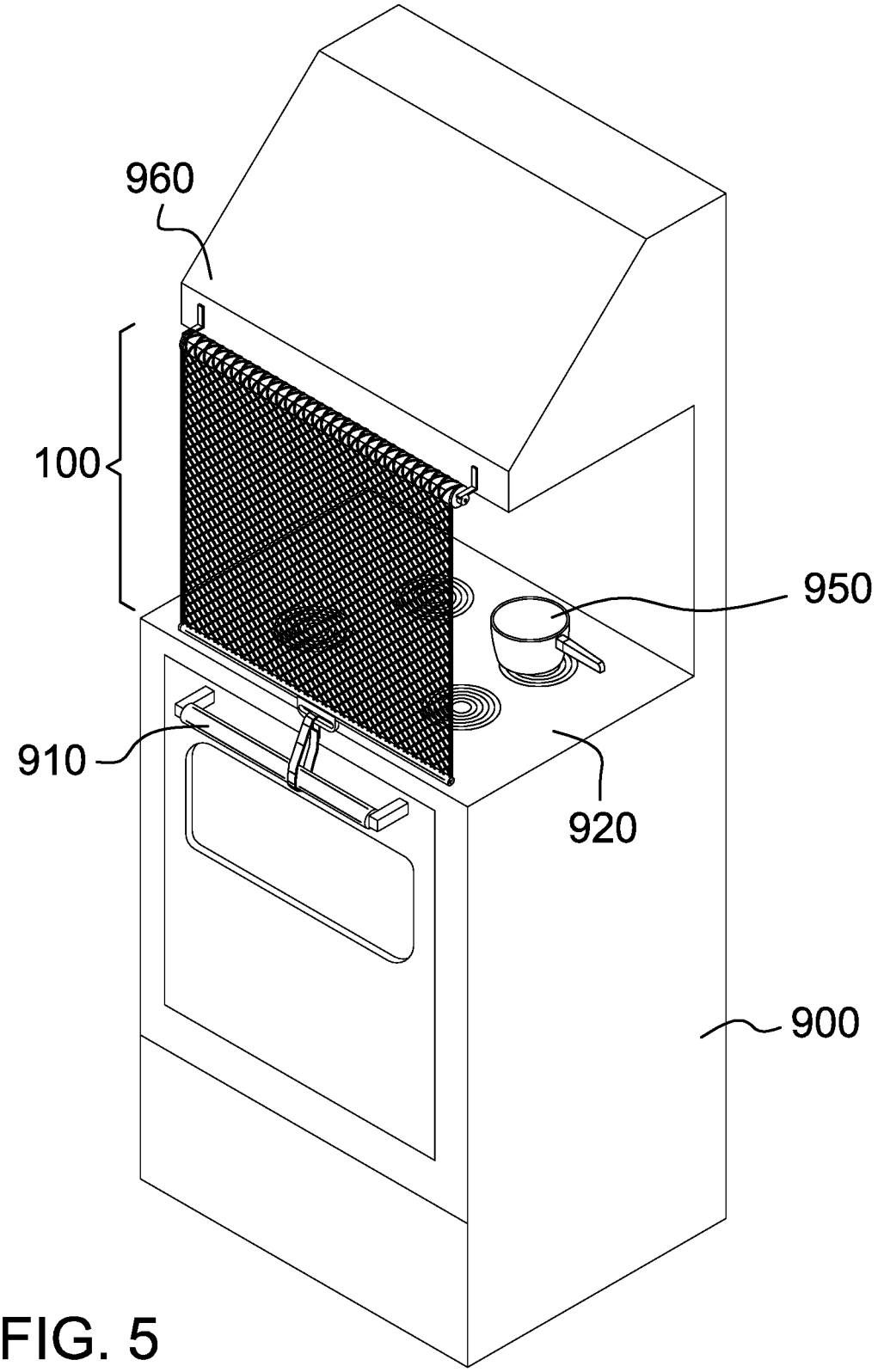
FIG. 5 is an in-use view of an embodiment of the disclosure.

Detailed reference will now be made to a first potential embodiment of the disclosure, which is illustrated in FIGS. 1 through 5.

The retractable stovetop shielding screen 100 (hereinafter invention) comprises a roller 200, a screen 230, a stiffening member 240, a pull-down grip 245, a retaining loop 250, a left mounting bracket 220, and a right mounting bracket 225. The invention 100 is a protective screen that deploys vertically from a location on the front of an above-stove support 960 and removably couples to a door handle 910 on an oven 900. The invention 100 is adapted to prevent children and pets from contacting a stove top 920 or cookware 950 on the stove top 920. The invention 100 provides visibility of the cookware 950 through the screen 230 when deployed. As non-limiting examples, the above-stove support 960 may be a range hood, a microwave oven, or a cabinet.

The roller 200 may be a cylinder or spool. The length of a longitudinal axis of the roller 200 may be at least ¾ of the width of the oven 900. The roller 200 may be mounted to the front of the above-stove support 960 such that the longitudinal axis of the roller 200 is oriented horizontally. The screen 230 may couple to the roller 200 such that the screen 230 may wrap around the roller 200 when the roller 200 rotates in a first rotational direction 280 around the longitudinal axis of the roller 200. The screen 230 may unwrap from the roller 200 when the roller 200 rotates in a second rotational direction 285.

The roller 200 may comprise one or more axles 205. The roller 200 may rotate around the one or more axles 205 that are rotationally coupled to the roller 200. The one or more axles 205 may be aligned with the longitudinal axis of the roller 200. The one or more axles 205 may be coupled to the left mounting bracket 220 and the right mounting bracket 225.

The roller 200 may comprise one or more spring retractors 210. The one or more spring retractors 210 may cause the roller 200 to rotate in the first rotational direction 280 relative to the one or more axles 205. As a non-limiting example, the one or more spring retractors 210 may be one or more torsion springs within the roller 200 that are coupled between the one or more axles 205 and the roller 200.

The screen 230 may be a rectangular wire mesh screen. The screen 230 may be non-opaque and may allow items on the stove top 920 to be viewed through the screen 230 when the screen 230 is deployed between the stove top 920 and a user. A first end of the screen 232 may be coupled to the roller 200. A second end of the screen 234 may be coupled to the stiffening member 240. In some embodiments, the lateral sides of the screen 230 may comprise a trim edge 235 to provide a finished edge to the wire mesh.

The stiffening member 240 may be an armature that is substantially the same longitudinal length as the roller 200. The stiffening member 240 may couple to the screen 230 and to the pull-down grip 245.

The pull-down grip 245 may be a handle used to deploy the screen 230. Pulling on the pull-down grip 245 may cause the screen 230 to pull on the roller 200 and cause rotation of the roller 200 in the second rotational direction 285. The invention 100 is adapted to allow the user to control the retraction of the screen 230 back onto the roller 200 by relaxing the tension of the pulling force applied to the pull-down grip 245 so that the one or more spring retractors 210 cause the roller 200 to rotate in the first rotational direction 280.

The retaining loop 250 may be a flexible strap. The flexible strap may comprise free ends that may attach to each other to form the retaining loop 250. The retaining loop 250 may be coupled to the pull-down grip 245. The retaining loop 250 may be opened by separating the ends of the flexible strap and may be closed by fastening the ends of the flexible strap to each other. The retaining loop 250 may be opened and the ends of the flexible strap may be passed around the door handle 910 when the pull-down grip 245 is pulled to be adjacent to the door handle 910. The retaining loop 250 may then be closed by fastening the ends of the flexible strap to each other and the retaining loop 250 may prevent the screen 230 from retracting.

In some embodiments, the ends of the flexible strap may fasten to each other using a hook and loop fastener 255.

The left mounting bracket 220 and the right mounting bracket 225 may be coupled to the front of the above-stove support 960 separated by a distance such that the roller 200 may fit between the left mounting bracket 220 and the right mounting bracket 225. The left mounting bracket 220 and the right mounting bracket 225 each comprise an L-shaped armature 260. One leg of the L-shaped armature 260 couples to the front of the above-stove support 960 via a mounting bracket fastener 290. The other leg of the L-shaped armature 260 comprises a barrel 262 having a central aperture 264. The central aperture 264 may be oriented horizontally when the left mounting bracket 220 or the right mounting bracket 225 are installed on the front of the above-stove support 960. The one or more axles 205 located on the left side of the roller 200 slides into the central aperture 264 on the left mounting bracket 220. The one or more axles 205 located on the right side of the roller 200 slides into the central aperture 264 on the right mounting bracket 225. The left mounting bracket 220 and the right mounting bracket 225 hold the roller 200 in front of the above-stove support 960.

In some embodiments, the mounting bracket fastener 290 that couples the L-shaped armature 260 to the above-stove support 960 may be double sided tape. In some embodiments, the mounting bracket fastener 290 that couples the L-shaped armature 260 to the above-stove support 960 may be one or more permanent magnets.

In use, the left mounting bracket 220 and the right mounting bracket 225 are coupled to the front of the above-stove support 960 with the roller 200 installed between them. When it is desired to prevent the children and/or the pets from contacting the stove top 920 and/or the cookware 950, the user may grasp and pull the pull-down grip 245, causing the screen 230 to spool off of the roller 200. The pull-down grip 245 may be pulled to the door handle 910 and the retaining loop 250 may be coupled to the door handle 910 of the oven 900 to hold the screen 230 in place. When it is no longer desired to block access to the stove top 920, the user may hold the pull-down grip 245 while uncoupling the retaining loop 250 and may then reduce pulling tension on the pull-down grip 245, allowing the roller 200 to retract the screen 230.

Definitions

Unless otherwise stated, the words "up", "down", "top", "bottom", "upper", and "lower" should be interpreted within a gravitational framework. "Down" is the direction that gravity would pull an object. "Up" is the opposite of "down". "Bottom" is the part of an object that is down farther than any other part of the object. "Top" is the part of an object that is up farther than any other part of the object. "Upper" refers to top and "lower" refers to the bottom. As a non-limiting example, the upper end of a vertical shaft is the top end of the vertical shaft.

As used in this disclosure, an "aperture" is an opening in a surface. Aperture may be synonymous with hole, slit, crack, gap, slot, or opening.

As used in this disclosure, an "axle" is a cylindrical shaft that is inserted through the center of an object such that the center axis of the object and the center axis of the axle are aligned and the object can rotate using the axle as an axis of rotation.

As used herein, the words "couple", "couples", "coupled" or "coupling", refer to connecting, either directly or indirectly, and does not necessarily imply a mechanical connection.

As used in this disclosure, a "cylinder" is a geometric structure defined by two identical flat and parallel ends, also commonly referred to as bases, which are circular in shape and connected with a single curved surface which may be referred to as the face. The axis of the cylinder is formed by the straight line that connects the center of each of the two identical flat and parallel ends of the cylinder. Unless otherwise stated within this disclosure, the term cylinder specifically indicates a right cylinder, which is defined as a cylinder wherein the curved surface perpendicularly intersects with the two identical flat and parallel ends.

As used herein, the word "desired" refers to a specific value or action within a range of supported values or action. A "desired" value or action indicates that a range of values or actions is enabled by the invention and that a user of the invention may select a specific value or action within the supported range of values or action based upon their own personal preference. As a non-limiting example, for a fan that supports operational speed settings of low, medium, or high, a user may select a desired fan speed, meaning that the user may select low, medium, or high speed based upon their needs and preferences at the time of the selection.

As used in this disclosure, a "fastener" is a device that is used to join or affix two objects. Fasteners generally comprise a first element, which is attached to the first object and a second element, which is attached to the second object such that the first element and the second element join to affix the first object and the second object. Common fasteners include, but are not limited to, hooks, zippers, snaps, clips, ties, buttons, buckles, quick release buckles, or hook and loop fasteners.

As used in this disclosure, "flexible" refers to an object or material which will deform when a force is applied to it, which will not return to its original shape when the deforming force is removed, and which may not retain the deformed shape caused by the deforming force.

As used herein, "front" indicates the side of an object that is closest to a forward direction of travel under normal use of the object or the side or part of an object that normally presents itself to view or that is normally used first. "Rear" or "back' refers to the side that is opposite the front.

As used in this disclosure, a "handle" is an object by which a tool, object, or door is held or manipulated with the hand.

As used in this disclosure, a "hook and loop fastener" is a fastener that comprises a hook surface and a loop surface. The hook surface comprises a plurality of minute hooks. The loop surface comprises a surface of uncut pile that acts like a plurality of loops. When the hook surface is applied to the loop surface, the plurality of minute hooks fastens to the plurality of loops securely fastening the hook surface to the loop surface.

As used in this disclosure, the word "lateral" refers to the sides of an object or movement towards a side. Lateral directions are generally perpendicular to longitudinal directions. "Laterally" refers to movement in a lateral direction.

As used herein, the word "longitudinal" or "longitudinally" refers to a lengthwise or longest direction.

As used in this disclosure, "opaque" refers to an object or material that prevents the passage of light and/or other forms of radiations through the object or material.

As used in this disclosure, an "oven" is an enclosed chamber that is equipped to heat objects placed within the enclosed chamber.

As used in this disclosure, a "screen" is a meshed structure made of wire, yarn, cloth, synthetic materials, or combinations thereof that allows for the free flow of air but prevents larger objects from passing through the meshed structure.

As used in this disclosure, a "spring" is a device that is used to store mechanical energy. This mechanical energy will often be stored by deforming an elastomeric material that is used to make the device, by the application of a torque to a rigid structure, or by a combination thereof. In some embodiments, the rigid structure to which torque is applied may be composed of metal or plastic.

As used in this disclosure a "strap" is a strip of leather, cloth, nylon, plastic, thin metal, rubber, or other flexible material, that is used to fasten, secure, carry, or hold onto something. A strap is sometimes used in conjunction with a buckle.

As used herein, the word "substantially" indicates that two or more attributes are the same except for a margin of error related to variances in materials, manufacturing processes, craftsmanship, installation, environmental conditions, or other factors that may influence the attributes and that the differences introduced by these factors are not considered detrimental to the operation of the invention as described herein.

With respect to the above description, it is to be realized that the optimum dimensional relationship for the various components of the invention described above and in FIGS. 1 through 5, include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A retractable stovetop shielding screen comprising:

a roller, a screen, a stiffening member, a pull-down grip, a retaining loop, a left mounting bracket, and a right mounting bracket;

wherein the retractable stovetop shielding screen is a protective screen that deploys vertically from a location on the front of an above-stove support and removably couples to a door handle on an oven;

wherein the retractable stovetop shielding screen is adapted to prevent children and pets from contacting a stove top or cookware on the stove top;

wherein the retractable stovetop shielding screen provides visibility of the cookware through the screen when deployed;

wherein the retaining loop is a flexible strap;

wherein the flexible strap comprises free ends that attach to each other to form the retaining loop;

wherein the retaining loop is coupled to the pull-down grip;

wherein the retaining loop is opened by separating the ends of the flexible strap and is closed by fastening the ends of the flexible strap to each other.

2. The retractable stovetop shielding screen according to claim 1 wherein the roller is a cylinder or spool;

wherein the length of a longitudinal axis of the roller is at least ¾ of the width of the oven;

wherein the roller is mounted to the front of the above-stove support such that the longitudinal axis of the roller is oriented horizontally.

3. The retractable stovetop shielding screen according to claim 2 wherein the screen couples to the roller such that the screen wraps around the roller when the roller rotates in a first rotational direction around the longitudinal axis of the roller;

wherein the screen unwraps from the roller when the roller rotates in a second rotational direction.

4. The retractable stovetop shielding screen according to claim 3 wherein the roller comprises one or more axles;

wherein the roller rotates around the one or more axles that are rotationally coupled to the roller;

wherein the one or more axles are aligned with the longitudinal axis of the roller;

wherein the one or more axles are coupled to the left mounting bracket and the right mounting bracket.

5. The retractable stovetop shielding screen according to claim 4 wherein the roller comprises one or more spring retractors;

wherein the one or more spring retractors cause the roller to rotate in the first rotational direction relative to the one or more axles.

6. The retractable stovetop shielding screen according to claim 5 wherein the one or more spring retractors are one or more torsion springs within the roller that are coupled between the one or more axles and the roller.

7. The retractable stovetop shielding screen according to claim 5 wherein the screen is a rectangular wire mesh screen;

wherein the screen is non-opaque and is adapted to allow items on the stove top to be viewed through the screen when the screen is deployed between the stove top and a user;

wherein a first end of the screen is coupled to the roller;

wherein a second end of the screen is coupled to the stiffening member.

8. The retractable stovetop shielding screen according to claim 7 wherein each of the lateral sides of the screen comprise a trim edge to provide a finished edge to the wire mesh.

9. The retractable stovetop shielding screen according to claim 7 wherein the stiffening member is an armature that is substantially the same longitudinal length as the roller;

wherein the stiffening member couples to the screen and to the pull-down grip.

10. The retractable stovetop shielding screen according to claim 9 wherein the pull-down grip is a handle used to deploy the screen;

wherein pulling on the pull-down grip causes the screen to pull on the roller and cause rotation of the roller in the second rotational direction;

wherein the retractable stovetop shielding screen is adapted to allow the user to control the retraction of the screen back onto the roller by relaxing the tension of the pulling force applied to the pull-down grip so that the one or more spring retractors cause the roller to rotate in the first rotational direction.

11. The retractable stovetop shielding screen according to claim 10 wherein the retaining loop is opened and the ends of the flexible strap are passed around the door handle when the pull-down grip is pulled to be adjacent to the door handle;

wherein the retaining loop is closed by fastening the ends of the flexible strap to each other and the retaining loop prevents the screen from retracting.

12. The retractable stovetop shielding screen according to claim 11 wherein the ends of the flexible strap fasten to each other using a hook and loop fastener.

13. The retractable stovetop shielding screen according to claim 12 wherein the left mounting bracket and the right mounting bracket are coupled to the front of the above-stove support separated by a distance such that the roller fits between the left mounting bracket and the right mounting bracket.

14. The retractable stovetop shielding screen according to claim 13 wherein the left mounting bracket and the right mounting bracket each comprise an L-shaped armature;

wherein one leg of the L-shaped armature couples to the front of the above-stove support via a mounting bracket fastener;

wherein the other leg of the L-shaped armature comprises a barrel having a central aperture.

15. The retractable stovetop shielding screen according to claim 14 wherein the central aperture is oriented horizontally when the left mounting bracket or the right mounting bracket are installed on the front of the above-stove support.

16. The retractable stovetop shielding screen according to claim 15 wherein the one or more axles located on the left side of the roller slides into the central aperture on the left mounting bracket;

wherein the one or more axles located on the right side of the roller slides into the central aperture on the right mounting bracket;

wherein the left mounting bracket and the right mounting bracket hold the roller in front of the above-stove support.

17. The retractable stovetop shielding screen according to claim 16 wherein the mounting bracket fastener that couples the L-shaped armature to the above-stove support is double sided tape.

18. The retractable stovetop shielding screen according to claim 16 wherein the mounting bracket fastener that couples the L-shaped armature to the above-stove support is one or more permanent magnets.

* * * * *